United States Patent [19]

Breslow et al.

[11] 4,022,474

[45] May 10, 1977

[54] GAME APPARATUS

[75] Inventors: Jeffrey D. Breslow, Highland Park; Eugene Jaworski, Park Ridge, both of Ill.

[73] Assignee: Marvin Glass & Associates, Chicago, Ill.

[22] Filed: June 30, 1975

[21] Appl. No.: 591,393

[52] U.S. Cl. ..... 273/138 A; 46/241; 273/1 M

[51] Int. Cl.[2] ..... A63H 33/26; A63F 9/00

[58] Field of Search ..... 273/138 R, 138 A, 139, 273/1 M, 101, 108, 110, 118 A, 129 HA, 119 A, 123 A, 126 A, 141 A; 46/45, 241, 243 M, 243 E

[56] References Cited

UNITED STATES PATENTS

| | | | |
|---|---|---|---|
| 728,327 | 5/1903 | Tanron | 273/119 A |
| 1,197,170 | 9/1916 | Aylesworth et al. | 273/1 M X |
| 1,198,578 | 9/1916 | Reimer | 46/241 |
| 1,608,353 | 11/1926 | Zaikine | 46/241 |
| 2,083,119 | 6/1937 | Hense | 273/110 X |
| 2,721,082 | 10/1955 | Hunold | 273/138 R |
| 3,203,699 | 8/1965 | Pearson, Jr. | 273/119 A |
| 3,208,185 | 9/1965 | Silvera | 46/241 |

FOREIGN PATENTS OR APPLICATIONS

| | | | |
|---|---|---|---|
| 498,576 | 5/1930 | Germany | 273/141 A |
| 611,947 | 11/1948 | United Kingdom | 46/241 |
| 1,131,596 | 10/1968 | United Kingdom | 273/138 A |

*Primary Examiner*—Richard C. Pinkham
*Assistant Examiner*—Arnold W. Kramer

[57] ABSTRACT

A game apparatus having a game board with an elevated playing surface forming the top of a housing mounted on the game board. The housing encloses an electric motor having a magnetic shaft extending upwardly through the elevated playing surface. A plurality of magnetic playing pieces, formed in the shape of lightning bolts, are placed on the elevated playing surface about the magnetic shaft and are propelled randomly outwardly by rotation of the magnetic shaft, off of the elevated playing surface onto one of a plurality of stations on the surrounding game board. The stations include indicia which either eliminates the player of the game or requires him to pay a penalty in order to have his playing piece repositioned on the elevated playing surface. The player having the last remaining playing piece on the playing surface is the winner of the game.

6 Claims, 4 Drawing Figures

GAME APPARATUS

BACKGROUND AND SUMMARY OF THE INVENTION

This invention relates to game devices and in particular to a game of chance which operates mechanically to eliminate particular players from the game.

Games of chance have been provided in which players are eliminated one by one from the game as particular events take place. Some games of this type have intriguing mechanical elements and are interesting and amusing, especially to children, because of the mysterious manner in which they operate. Games of this type often have been well received by the public.

It is an object of the present invention to provide a new and interesting game of chance, utilizing relatively simple yet durable construction and components.

In an exemplary embodiment of the present invention, a housing is provided having an elevated playing surface and a surrounding lower game board with a plurality of playing stations about the elevated playing surface. A plurality of metallic playing pieces are provided, one for each player of the game, and a motor driven magnetic shaft or spindle protrudes through the playing surface for attracting the playing pieces and propelling at least some of the playing pieces outwardly therefrom off of the elevated playing surface onto one of the playing stations thereabout.

BRIEF DESCRIPTION OF THE PREFERRED EMBODIMENT

Figure 1:
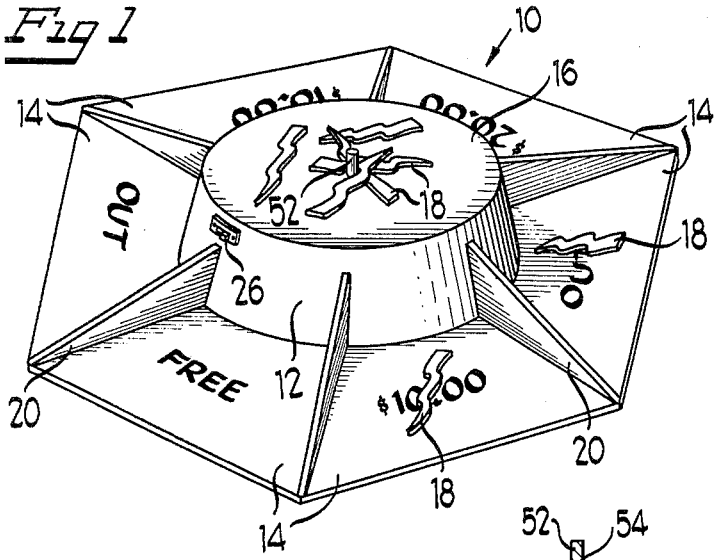
FIG. 1 is a perspective view of the game apparatus of the present invention.

The game apparatus of the present invention, generally designated 10 (FIG. 1), includes a generally cylindrical, slightly tapered housing 12 and a surrounding game board having a plurality of stations 14 about the base of the housing 12. The top 16 of the housing provides a playing surface for a plurality of playing pieces 18, as best seen in FIG. 1. Each of the stations 14 is separated from adjacent stations by vertical triangular ribs 20 which extend downwardly from the side housing 12 to the outer periphery of each station 14. Each player has one or more playing pieces which are coded (e.g., color) to the respective players.

The housing 12 encloses a drive means, generally designated 24. The drive means 24 includes an off-on switch 26 having one lead 28 connected to one terminal of a battery housing 30 and a second lead 32 connected to a rotary drive motor 34. The other terminal 36 of the battery casing is connected by a lead 38 to the motor. Thus, as the off-on switch 26 is moved to the on position, the drive motor 34 is connected in series with a battery 40 and begins to rotate. The motor 34 will continue to rotate until the switch 26 is moved to the off position.

The motor 34 is mounted within the housing 12 by a cylindrical flange 44 so that its shaft 46 extends generally vertically upward. A magnet housing 48 is secured to the motor shaft 46 and encloses a permanent magnet 50. A shaft or spindle 52 is secured within the magnet housing, by a flange 53, with its upper end protruding through a hole 54 in the playing surface 16. In this manner, a magnetic field will be created about the spindle 52.

The playing pieces 18, previously referred to, are formed of a ferrous type material so that they will be attracted by the magnetic spindle 52. As the spindle 52 rotates, the playing pieces will be propelled outwardly therefrom and, in some instances, off of the playing surface 16 and onto one of the stations 14.

Figure 4:
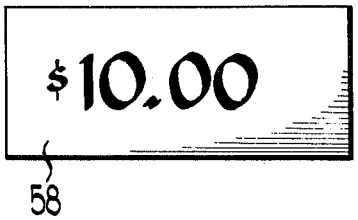
FIG. 4 is a piece of play money used in playing the game.
Figure 3:
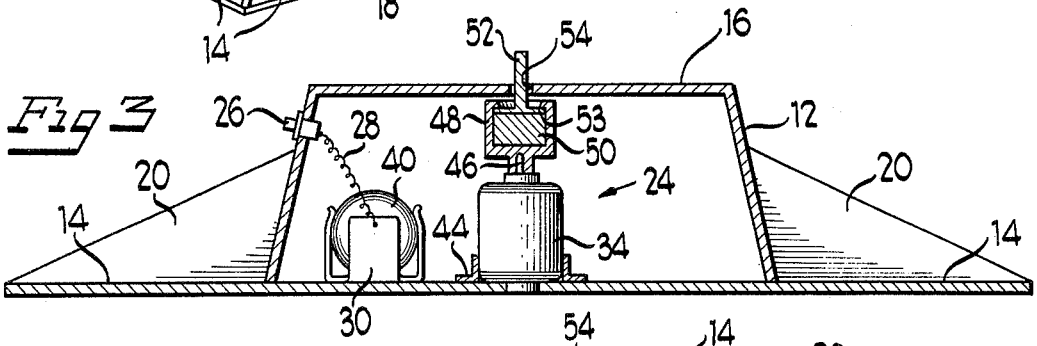
FIG. 3 is a vertical section taken generally along line 3—3 of FIG. 2.
Figure 2:
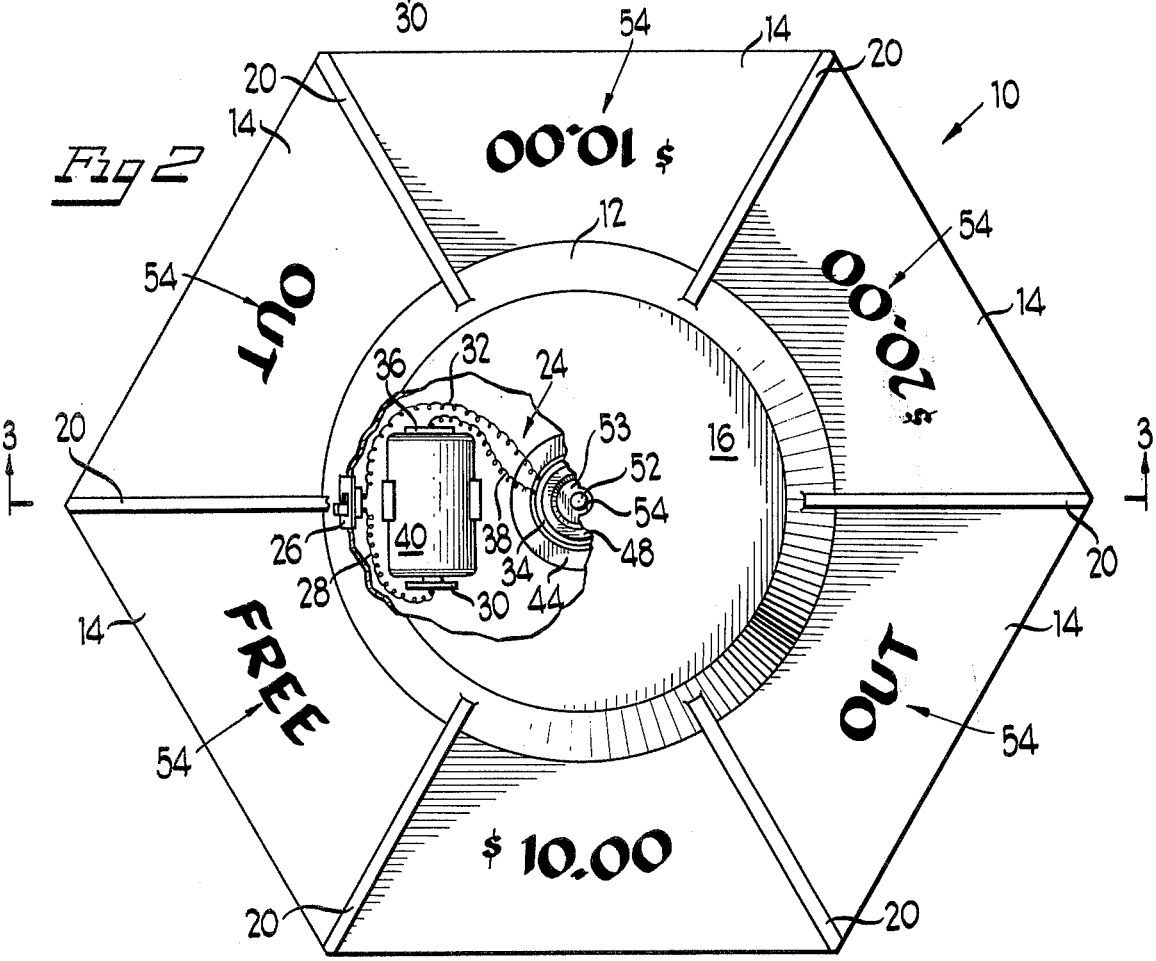
FIG. 2 is a fragmented top plan view of the game apparatus of FIG. 1, on an enlarged scale, showing the interior power supply and drive means.

Each of the stations 14 includes indicia, generally designated 54, which requires some action by the player whose playing piece lands on that particular station. For example, the word "out" on a station 14 indicates that a player is eliminated from the game. The word "free" indicates that a player may place his playing piece back onto the playing surface without any penalty. The particular dollar amounts on the other stations indicates that a player must pay that particular amount into a kitty or bank before he can replace his playing piece back on the playing surface. Play money 58, as shown in FIG. 4, can be used for the game.

Two or more players can play the game. They begin by placing their playing pieces 18 onto the playing surface about the spindle 52 and starting the drive motor 34 by moving the switch 26 to the on position. The particular order of players placing their playing pieces (e.g., color coded) about the spindle 52 can be determined by various schemes. Each player is allotted a certain amount of play money with which to begin the game. Each time a player's playing piece falls onto one of the stations 14 he must follow the instructions on that station. As mentioned above he may be out of the game, he may be able to replace his playing piece back onto the playing surface free of a penalty, or he may have to pay the amount shown on the station to replace his playing piece 18 back onto the playing surface 16 for the next turn. The game continues until only one player has his playing piece remaining on the playing surface 16. Besides being eliminated from the game by falling onto one of the out stations, a player also can be eliminated from the game if he must pay a charge to replace his playing piece back onto the playing surface and he has insufficient money remaining to pay the charge.

In effect, since the spindle 52 is magnetized, the playing pieces 18 will be attracted thereto. In addition, since the playing pieces are shaped as lightning bolts, shoulders are formed along the edges of the playing pieces. When the motor is turned on to rotate the spindle 52, various interactions between the spindle and the shoulders of the playing pieces and between the playing pieces themselves are created and at least some of the playing pieces are flung or propelled randomly outwardly away from the spindle toward the stations 14.

An added dimension can be provided within the contemplation of the present invention by utilizing a reversible motor and appropriate circuitry to permit a player to operate the motor in either direction without prior notice to the opposing players.

The foregoing detailed description has been given for clearness of understanding only and no unnecessary limitations should be understood therefrom as some modifications will be obvious to those skilled in the art.

We claim:

1. A game apparatus, comprising: a game board having a generally centrally disposed housing thereon defining a generally flat elevated playing surface horizontally on top of the housing, with the game board surrounding and protruding radially outwardly of the housing below the elevated playing surface;

drive means mounted within the housing and having a rotatable magnetic spindle extending vertically upwardly through the playing surface;

means to selectively energize said drive means; and a plurality of generally flat irregularly shaped metallic playing pieces, at least one for each player of the game, positionable on the elevated playing surface about the rotatable spindle whereby the playing pieces are magnetically attracted to the spindle so that when rotated by said drive means at least some of the playing pieces are moved by the spindle over the playing surface into engagement with at least some of the other playing pieces to propel at least some of the playing pieces off of the playing surface onto the game board.

2. The game apparatus of claim 1 wherein said game board has means defining a plurality of distinguishable playing stations thereon including indicating means for determining the play of the game.

3. The game apparatus of claim 2 including a plurality of equally spaced vertical ribs between the game board and the housing tapering downwardly to the surface of the game board defining said stations therebetween.

4. The game apparatus of claim 2 wherein the indicating means for determining the play of the game on the distinguishable playing stations includes penalties and rewards for the players of the game whose playing piece lands on one of said distinguishable playing stations in response to acceleration imparted thereto by the spindle.

5. The game apparatus of claim 1 wherein said playing pieces are generally flat irregularly shaped metallic pieces generally in the form of lightning bolts having surfaces within which the rotating spindle can engageably contact for randomly imparting sufficient acceleration to the playing pieces upon rotation of the magnetic spindle.

6. The game apparatus of claim 1 wherein said playing pieces are color coded for each player of the game.

* * * * *